US005673665A

United States Patent [19]

Kim

[11] Patent Number: 5,673,665

[45] Date of Patent: Oct. 7, 1997

[54] ENGINE WITH RACK GEAR-TYPE PISTON ROD

[75] Inventor: Min-Tae Kim, Seoul, Rep. of Korea

[73] Assignee: Kia Motors Corporation, Seoul, Rep. of Korea

[21] Appl. No.: 656,532

[22] Filed: May 31, 1996

[30] Foreign Application Priority Data

Nov. 11, 1995 [KR] Rep. of Korea ..... 95-48466
Mar. 26, 1996 [KR] Rep. of Korea ..... 96-8339

[51] Int. Cl.[6] ..... F02B 75/26

[52] U.S. Cl. ..... 123/197.1; 123/197.3; 123/197.5

[58] Field of Search ..... 123/197.1, 197.3, 123/197.5; 74/579 E, 575, 577

[56] References Cited

U.S. PATENT DOCUMENTS 1,434,146 10/1922 Powell ..... 123/197.1
1,734,489 11/1929 Jereb ..... 123/197.1
3,868,932 3/1975 Toth ..... 123/197.1
4,433,649 2/1984 Shin ..... 123/197.5
4,907,548 3/1990 Lee ..... 123/197.3

*Primary Examiner*—Marguerite McMahon

[57] ABSTRACT

Disclosed is an engine with a rack gear-type piston rod, including first and second cylinders disposed oppositely to each other along a common axis. The cylinders respectively have first and second pistons that move back and forth along the common axis, and a piston rod, for connecting the first piston to the second piston is provided with upper and lower gear teeth formed on its opposing faces enabling the piston rod to move back and forth in response to the back and forth motion of the pistons. There is also provided a first gear train that includes a pair of gears meshing with the upper and lower gear teeth, respectively. The pair of gears rotate in opposite directions to each other in response to the back and forth motion of the piston rod. Finally, first and second one way clutches are respectively mounted on each side of the upper and lower gears.

5 Claims, 6 Drawing Sheets

ENGINE WITH RACK GEAR-TYPE PISTON ROD

BACKGROUND OF THE INVENTION

1. Field of the Invention

The present invention relates to an automotive engine and, more particularly, to an automotive engine in which a portion of power generated by an expansion stroke of one or more pistons can be used in an exhaust or a compression stroke of one or more other pistons and the rest of the power can be transmitted to an output shaft through a plurality of gears meshed with a rack gear of one or more piston rods.

2. Description of the Related Art

Generally, the internal combustion engine is a device used to convert the chemical energy of fuel into heat energy, and then to convert this heat energy into useable mechanical energy. This process of conversion is achieved by combining the appropriate amounts of air and fuel, and burning the mixture in an enclosed cylinder at a controlled rate. A movable piston in the cylinder is forced down by the force from the expanding gases cause by combustion.

The movable piston in the cylinder is connected to the top portion of a piston rod. The bottom portion of the piston rod is attached to the offset portion of a crankshaft. The reciprocating movement of the piston is converted to rotary motion of the crankshaft, which in turn supplies the power to drive the vehicle.

In conventional four-stroke-cycle engines, 720 degrees of crankshaft rotation are required for obtaining the power. This figure would indicate that other strokes are used for the production of power. For this reason, four to eight cylinders are regularly disposed through the angle 720 degrees of the crankshaft rotation.

A cylinder bore is the same diameter of the engine's cylinder and the size of the cylinder bore's diameter is a major factor in determining engine displacement along with the length of stroke and number of cylinders. Particularly, the engine's characteristics are determined by the cylinder bore's diameter and the engine's stroke. The power that an engine is able to produce depends very much on engine displacement. Engine displacement can be increased by engine design in three ways: (1) increasing cylinder bore diameter, (2) lengthening the stroke, and (3) increasing the number of cylinders.

To improve the intake and exhaust, it is preferable to increase the cylinder bore diameter, and to improve the durability in a high speed range, it is preferable to shorten the stroke. To enhance the torque of the engine having a limited displacement, however, it is preferable to lengthen the stroke.

In the four-stroke-cycle engine, when the reciprocating movement of the piston is converted to rotary motion of the crankshaft, the axis of the piston motion and the axis of the piston rod movement offset each other so that the piston rod reciprocates within the maximum angle. Therefore, a portion of power generated in the explosion and expansion strokes is vertically transmitted towards the inner wall of the cylinder through piston rings, resulting in the wear of the cylinder bore and low engine efficiency.

SUMMARY OF THE INVENTION

Therefore, the purpose the present invention is to solve the above-mentioned problems.

It is an object of the present invention to provide an engine with a rack gear-type piston rod, which can minimize piston power transmitted to the cylinder bore to prevent the wear of the cylinder bore and can increase engine output.

According to an embodiment of the present invention, to achieve the above object, the present invention provides an engine with a rack gear-type piston rod, comprising:

first and second cylinders disposed oppositely to each other along a common axis, the cylinders respectively having first and second pistons that move back and forth along the common axis;

a piston rod, for connecting the first piston to the second piston, that is provided with upper and lower gear teeth formed on its opposing faces enabling back and forth motion that responds to the back and forth motion of the pistons;

a first gear train including a pair of gears meshing with the upper and lower gear teeth, respectively, the pair of gears rotating in an opposite direction to each other in response to the back and forth motion of the piston rod;

first and second one way clutches respectively mounted on each side of the upper and lower gears;

first and second middle gears respectively connected with the first and second one way clutches through first and second shafts, respectively; and an output gear disposed between and engaged with the first and second middle gears, the output gear being connected to an output shaft.

In addition, it is preferable that the engine further comprises of a second gear train aligned with the first gear train.

It is also preferable that the piston rod has a rectangular section.

According to another embodiment of the present invention, to achieve the above mentioned object, the present invention provides an engine with a rack gear-type piston rod, comprising:

first and second cylinders disposed oppositely to each other along a first common axis, the cylinders respectively having first and second pistons that move back and forth along the first common axis;

third and fourth cylinders disposed oppositely to each other along a second common axis with the third and fourth cylinders respectively having third and fourth pistons that move back and forth along the second common axis;

a first piston rod, for connecting the first piston to the second piston, that is provided with upper and lower gear teeth formed on its opposing faces for enabling back and forth motion that responds to the back and forth motion of the pistons;

a second piston rod, for connecting the third piston to the fourth piston, that is provided with upper and lower gear teeth formed on its opposing faces for enabling back and forth motion that responds to the back and forth motion of the third and fourth pistons with a phase difference of 180 degrees;

a first gear train including at least three gears engaging the upper and lower portions of the first and second piston rods;

the three gears rotating in opposite directions in response to the back and forth motion of the piston rods;

one way clutches mounted on one side of each of the three gears, respectively;

a second gear train including at least three middle gears each connected respectively to one of the one way clutches through the respective middle shaft and idle gears which are engaged between the middle gears; and an output gear connected to one of the middle gears of the second gear train.

BRIEF DESCRIPTION OF THE DRAWINGS

A more complete appreciation of this invention, and many of the attendant advantages thereof, will be readily apparent with reference to the following detailed description when considered with the attached drawings in which like reference symbols indicate the same or similar components, wherein.

DETAILED DESCRIPTION OF EMBODIMENTS

Figure 1:
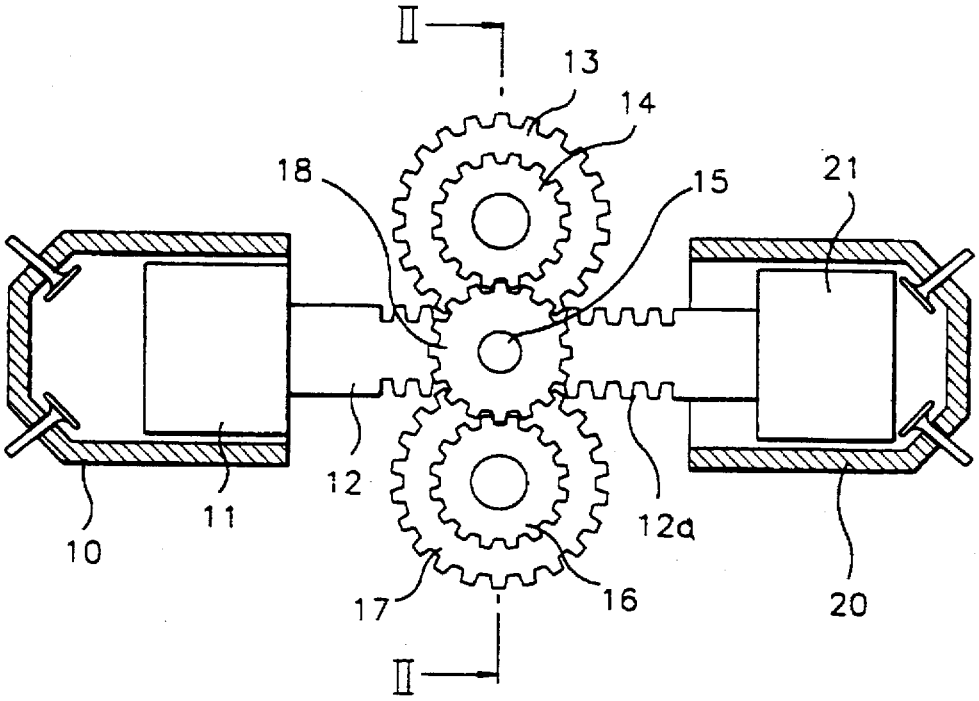
FIG. 1 is a partial sectional front view illustrating an engine with a rack gear-type piston rod in accordance with a first embodiment of the present invention.

Preferred embodiments of the present invention will now be described in detail with reference to the attached drawings.

Certain terminology will be used in the following description for convenience and reference only and is not to be interpreted as limiting in scope. The words "clockwise", "counter-clockwise", "left" and "right" will designate directions in the drawings to which reference is made.

Figure 2:
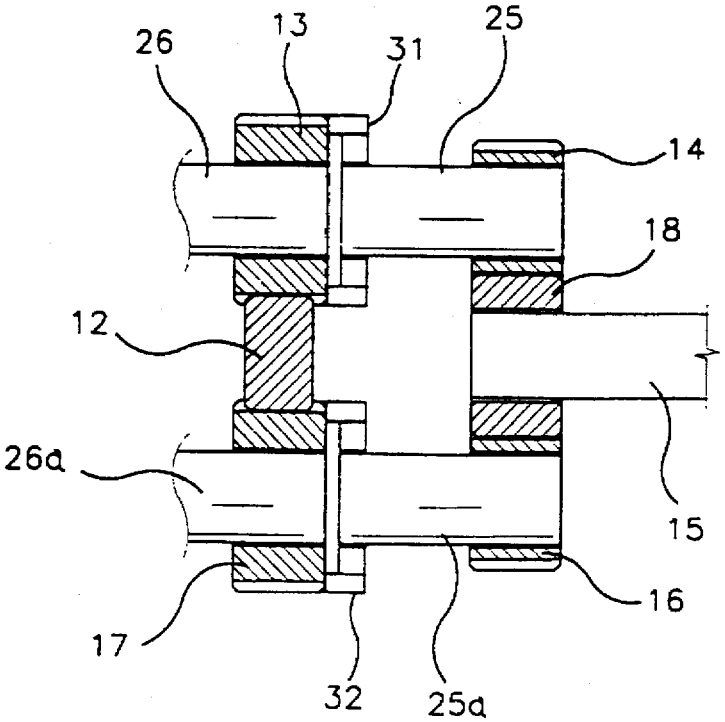
FIG. 2 is a side sectional view taken along lines II—II in FIG. 1.
Figure 3:
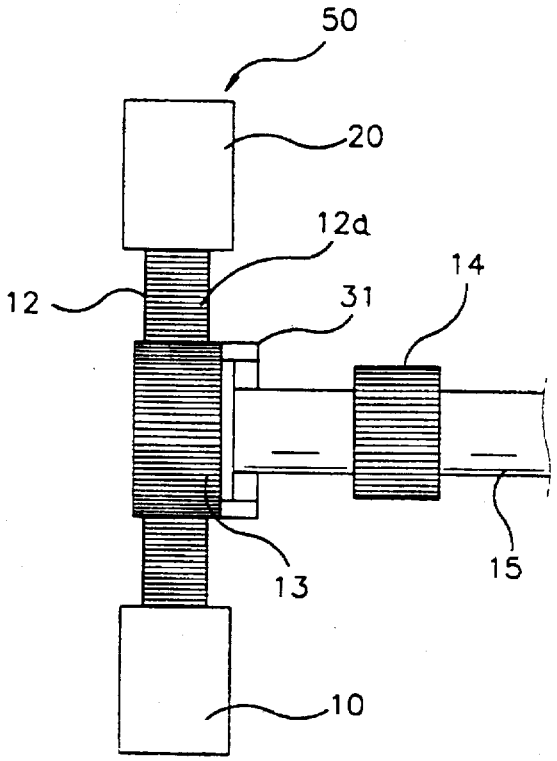
FIG. 3 is a planar view of FIG. 1.

Referring to FIGS. 1 to 3, these drawings show an engine with a rack gear-type piston rod in accordance with a first embodiment of the present invention.

An engine comprises of first and second cylinders, 10 and 20, which are disposed oppositely to each other along a common axis X. First and second pistons, 11 and 21, are disposed in the first and second cylinders, 10 and 20, respectively. The engine is designed such that the first piston 11 in the first cylinder 10 is in an expansion stroke when the second piston 21 in the second cylinder 21 is in an exhaust or a compression stroke. The pistons, 11 and 21, are designed to move along the common axis. The first piston 11 is connected with the second piston by a rack gear-type piston rod 12 of which the upper and lower surfaces of which are provided with gear teeth 12*a*. The piston rod 12 moves back and forth along the common axis in response to the back and forth motion of the pistons, 11 and 12. Furthermore, the pistons 11 and 12 of the engine with the rack gear type piston rod 12 simultaneously perform their relative strokes according to the following cycle:

Piston 11:
expansion-exhaust-intake-compression-expansion
Piston 21:
exhaust-intake-compression-expansion-exhaust As described above, since the first and second pistons 11 and 21 move along the common axis, when the first piston 11 receives power by the expansion of the compressed gas, a portion of the power serves as a drive source for an output shaft 15 through a gear train 50. The rest of the power is transmitted to the second piston 21 through the piston rod 12, enhancing the exhaust stroke of the second piston 21. Therefore, the stroke difference between the pistons 12 and 21 does not interfere with the motion of the piston rod 12.

As shown in FIGS. 1 and 2, the gear train 50 comprises of upper and lower gears, 13 and 17, which respectively mesh with gear teeth 12*a* formed on the upper and lower surfaces of the rack gear-type piston rod 12 that interconnects the pistons, 11 and 21. The upper and lower gears, 13 and 17, on one of their sides are provided with one way clutches 31 and 32, respectively. The one way clutches 31 and 32 are respectively connected to first and second middle gears 14 and 16 through shafts 25 and 25*a*, respectively. An output gear 18 is disposed between and engaged with the first and second middle gears 14 and 16.

Figure 4:
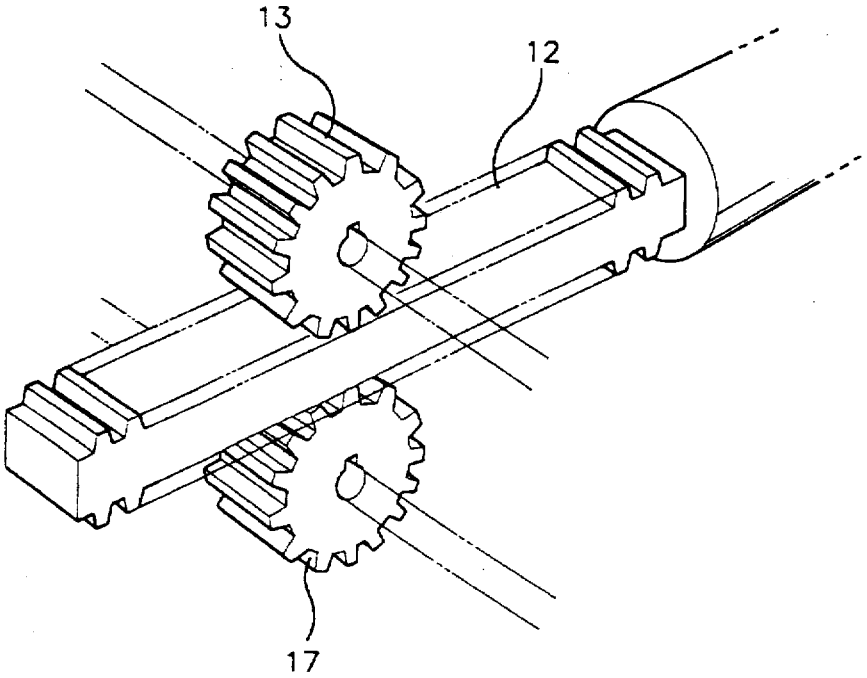
FIG. 4 is a schematic perspective view showing a meshing state of a rack gear-type piston rod and gear in accordance with the present invention.

Although the rack gear type piston rod 12 may have a circular section. It is preferable that the piston rod has a rectangular section as shown in FIG. 4.

Figure 5A:
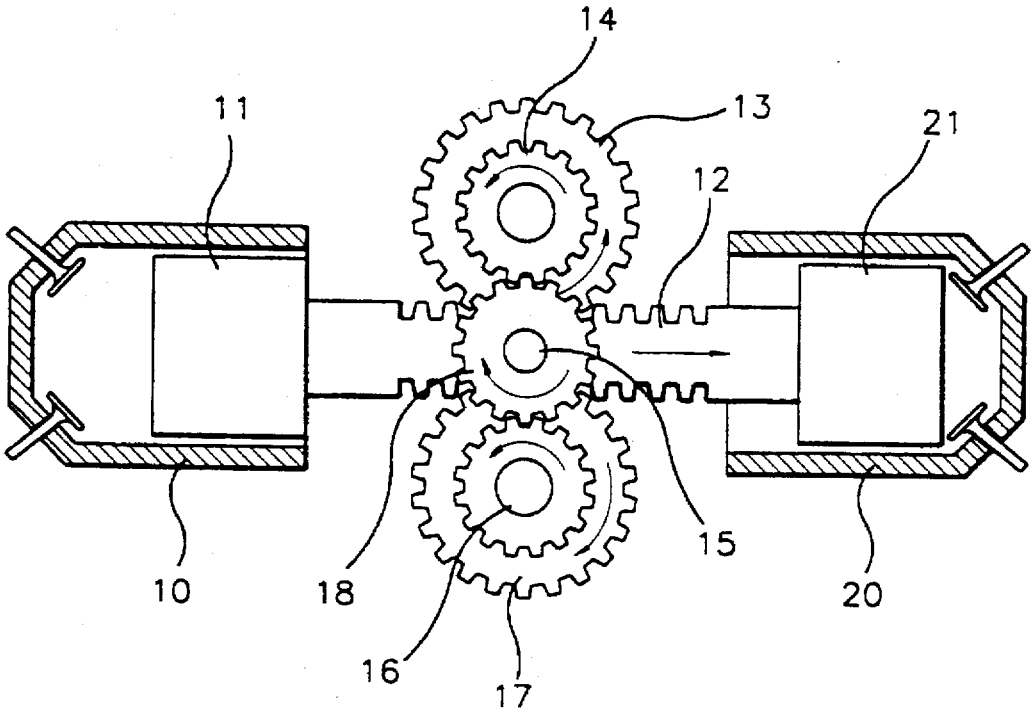
FIGS. 5*a* and 5*b* are views each showing rotation directions of each gear meshing with a rack gear-type piston rod where cylinders, disposed oppositely to each other, are in a compression stroke and an explosion stroke.
Figure 5B:
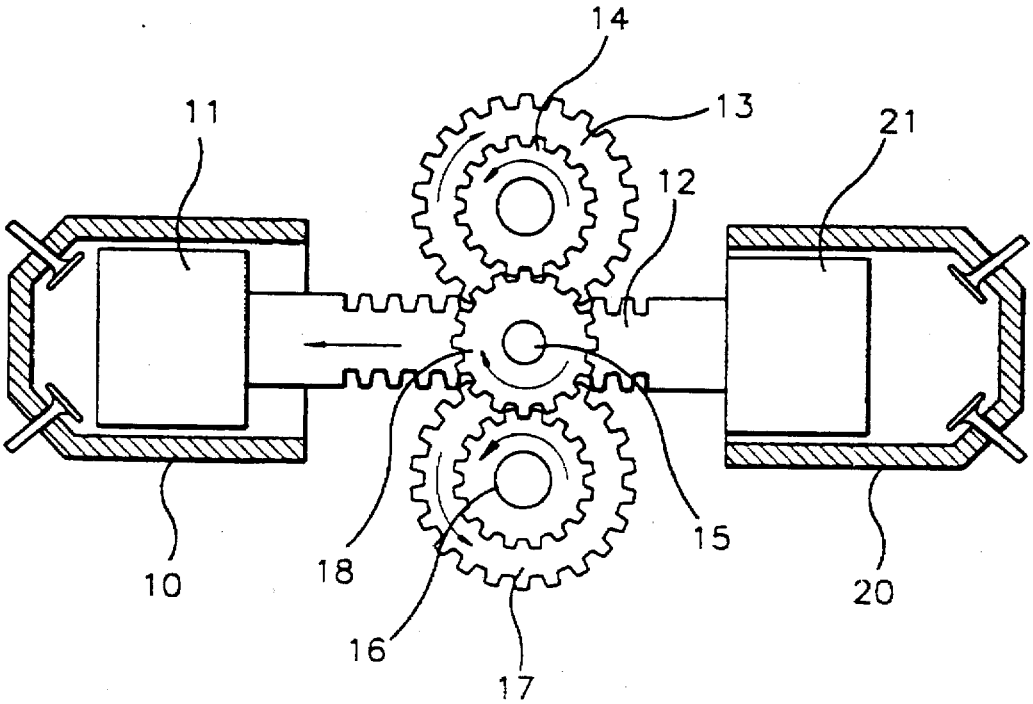

FIGS. 5*a* and 5*b* show each rotation direction of the upper and lower gears 13 and 17 meshing with a rack gear-type piston rod when the cylinders are in the compression stroke or the explosion stroke. The piston rod 12, for connecting the pistons, 11 and 21, move back and forth with the back and forth motion of the pistons, 11 and 21, while performing their stroke cycle.

While the piston rod moves back and forth, the upper and lower gears 13 and 17 rotate in opposite directions to each other as shown by the arrow directions in FIGS. 5*a* and 5*b*. As shown in FIG. 5*a*, when the first piston 11 is in the expansion stroke while the second piston 21 is in the compression or exhaust stroke, the piston rod 12 is displaced towards the right. In response to this displacement of the piston rod 12, the upper gear 13 rotates in a counter-clockwise direction and the lower gear 17 in a clockwise direction.

At this point, since the first and second middle gears, 14 and 16, are respectively connected to the one way clutches, 31 and 32, through the shafts 25 and 25*a*, only one rotating force of the upper and lower gears, 13 and 17, is transmitted to either the first or second middle gears, 14 and 16. The output gear 18 engaged between the first and second middle gears 14 and 16 is rotated by the rotating force transmitted to either one of the middle gears, 14 and 16. In this embodiment, the one way clutches, 31 and 32, are designed to transmit the rotating force only in the counter-clockwise direction.

Accordingly, in FIG. 5*a*, since the lower gear 17 rotates in the clockwise direction, the one way clutch 32 mounted on the lower gear 17 runs idle so that the rotating force of the lower gear 17 cannot be transmitted to the second middle gear 16. However, since the upper gear 13 rotates in the counter-clockwise direction, this rotating force is transmitted to the first middle gear 14 through the one way clutch 31 and the shaft 25, whereby the output shaft 18 rotates in a clockwise direction by the counter-clockwise rotating force of the middle gear 14. At this point, the second middle gear 16 runs idle in the counter-clockwise direction by the rotating force of the output gear 18.

In the case where the first piston 11 is in the compression or exhaust stroke and the second piston 21 is in the expansion stroke, the piston rod 12 is displaced towards the left. In response to this displacement of the piston rod 12, the upper gear 13 rotates in the clockwise direction and the lower gear 17 rotates in the counter-clockwise direction. Accordingly, the rotating force of the upper gear 13 is not transmitted to the middle gear 14 by the one way clutch 30. The rotating force of the lower gear 17, on the other hand, is transmitted to the middle gear 16 by the one way clutch 31, thereby rotating the middle gear 16 in the counter-clockwise direction. As a result, the output shaft 18 meshing with the middle gear 16 rotates in the clockwise direction. At this point, the first middle gear 14 runs idle in the counter-clockwise direction.

The above described operation is repeatedly performed as the first and second pistons 11 and 21 alternately perform the compression or expansion stroke, thereby obtaining the driving force.

Figure 6:
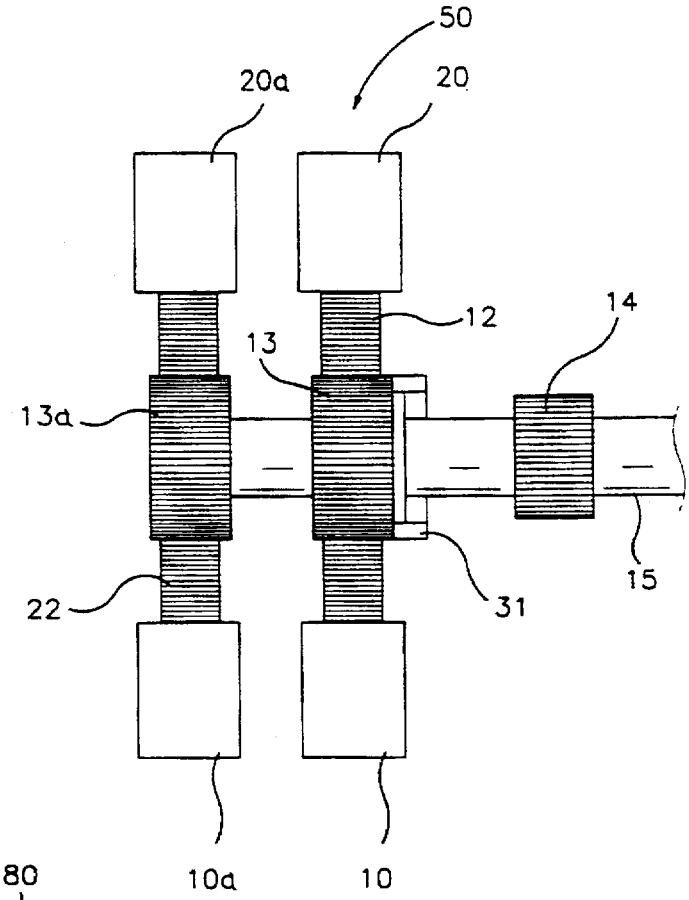
FIG. 6 is a planar view similar to FIG. 3, illustrating a modified example of the first embodiment.

FIG. 6 shows a modified example of the first embodiment. A pair of cylinders 10*a* and 20*a* are disposed parallel to the cylinders 10 and 20. Pistons of the cylinders 10*a* and 20*a* are connected with each other by a rack gear-type piston rod. The piston rod 12*a* is engaged through shafts 26 and 26*a* with gears 13*a* (only one is shown) that are connected to the upper and lower gears 13 and 17.

Therefore, the rotating force of the gears 13*a* is in response to the back and forth motion of the pistons of the cylinders, 11*a* and 12*a*. This response allows the output shaft 15 to receive higher driving force.

Figure 7:
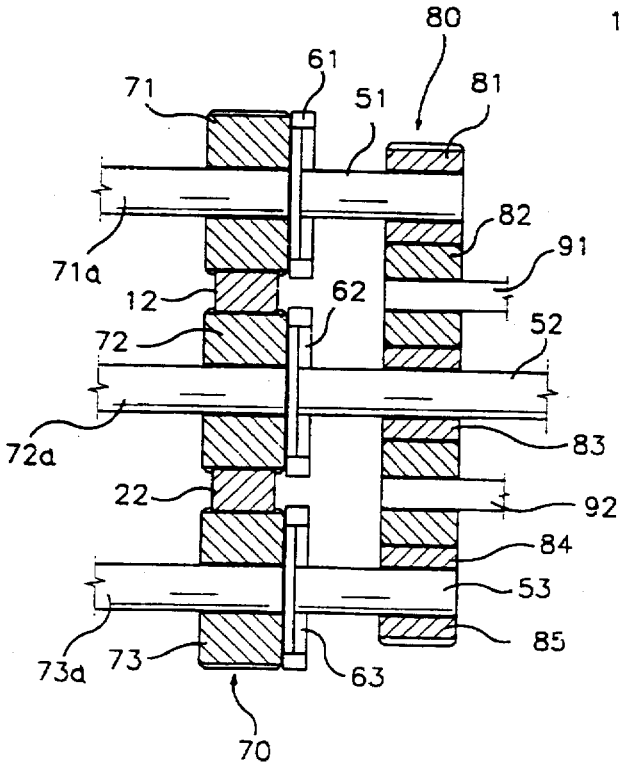
FIG. 7 is a schematic front view showing a meshing state of a rack gear-type piston rod and gears in accordance with a second embodiment of the present invention.
Figure 8:
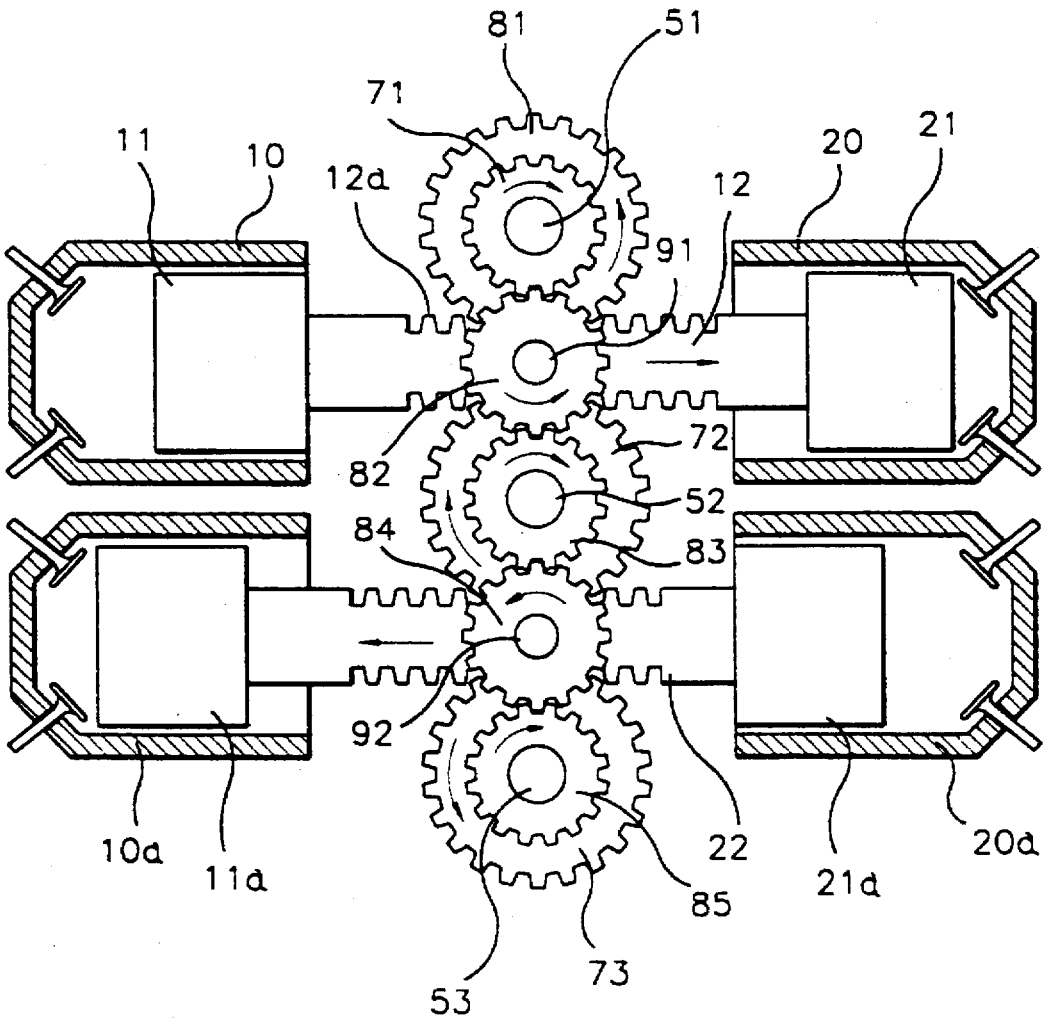
FIGS. 8 and 9 are views each showing rotation directions of each gear meshing with a rack gear-type piston rod depicted in FIG. 7 where cylinders, disposed oppositely to each other, are in a compression stroke and an explosion stroke.
Figure 9:
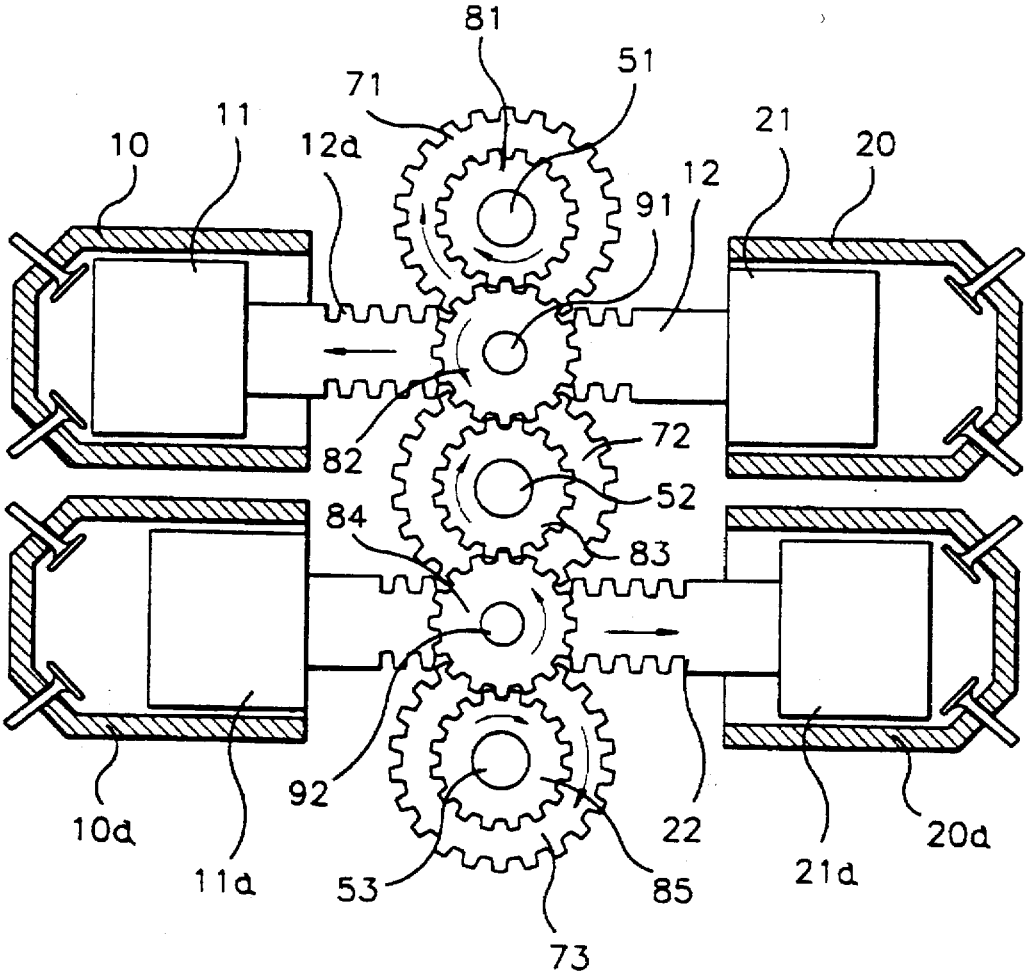

FIGS. 7 to 9 show an engine with a rack gear-type piston rod according to a second embodiment of the present invention. The engine of this embodiment comprises of first and second cylinders 10 and 20 disposed oppositely to each other along a common axis X1 and third and fourth cylinders 10*a* and 20*a*, disposed oppositely to each other along a common axis X2 that is parallel to the common axis X1. The first and second cylinders respectively have pistons, 11 and 21, which both move back and forth along the common axis X1 and the third and fourth cylinders respectively have pistons, 11*a* and 21*a*, which both move back and forth along the common axis X2 with a phase difference of 180 degrees from the pistons, 11 and 21. The pistons, 11 and 21, are connected to each other by a rack gear-type piston rod 12 provided with gear teeth 12*a*, the pistons 11*a* and 21*a* are connected to each other by a second rack gear-type piston rod 22 provided with gear teeth 22*a*.

In addition, the engine comprises a first gear train 70 having at least three gears 71, 72 and 73 which are engaged with the gear teeth 12*a* and 22*a* of the piston rods 12 and 22. As shown in FIG. 7, the gears 71, 72 and 73 are rotatably supported on shafts 71*a*, 72*a* and 73*a*.

The pistons 11, 11*a*, 12 and 12*a* of the engine perform their relative strokes according to the following cycle:

Pistons 11 and 11*a*:

expansion-exhaust-intake-compression-expansion

Pistons 21 and 21*a*:

exhaust-intake-compression-expansion-exhaust

Therefore, when the pistons, 11 and 11*a*, obtain driving force by the expansion stroke, the driving force becomes a drive source of the output shaft 15 through the gears. A portion of the driving force is transmitted to the corresponding second and fourth pistons, 21 and 21*a*, through the piston rods, 12 and 22, respectively, thereby enhancing the exhaust stroke of the second and fourth pistons, 21 and 21*a*. Therefore, the moving directions of the piston rods 12 and 22 are designed to be opposite to each other.

The gears 71, 72 and 73, are each provided with one way clutches on one of their sides. The one way clutches, 61, 62 and 63, are respectively connected to middle gears, 81, 83 and 85, of a second gear train 80 through middle shafts, 51, 52 and 53, respectively. Idle gears, 82 and 84, are engaged between the middle gears 81, 83 and 85. The middle gear 83 responds to the output gear according to the first embodiment. The middle gear 52 connecting the one way clutch 62 to the middle gear 83 serves as the output shaft.

The idle gears, 82 and 84, are mounted on shafts, 91 and 92 respectively, and transmit the required rotating force to the middle gear 83 in response to the rotation of the middle gears, 81, 83 and 85. As shown in FIG. 8, when the piston rod 12 is displaced towards the right and the piston rod 22 is displaced towards the left. Since each rotating direction of the first and third gears, 71 and 73, is opposite to the rotating direction of the middle gear 83 mounted on the output shaft 53, the rotating force of the first and third gears, 71 and 73, is not transmitted to the middle gears, 81 and 85, by the one way clutches 61 and 63, respectively.

In addition, the rotating force of the second gear 72 is transmitted to the middle gear 83 of the second gear train 80 through the one way clutch 62 and the middle shaft 52. The rotating force transmitted to the middle gear 83 is then transmitted to the output shaft 52. As a result, the first and third gears 71 and 73, which rotate in an opposite direction to the middle gear 83, run idle by the displacement of the piston rods 12 and 22, rotating in directions indicated by the arrows as shown in FIG. 8.

Furthermore, as shown in FIG. 9, when the piston rods, 12 and 22, are displaced in the other direction, the rotating force of the first and third gears, 71 and 73, is transmitted to the middle gears, 81 and 85, through the one way clutches, 61 and 63, and the middle shafts, 51 and 53. The rotating force transmitted to the middle gears, 81 and 85, is transmitted through the idle gears, 82 and 84, to the middle gear 83 supported by the output shaft 52.

In addition, the rotating force of the second gear 72 cannot be transmitted by the operation of the one way clutch 62 mounted on the second gear 72 to the middle gears 83 and 85 of the second gear train 80. Therefore, the output shaft 52 rotates by the rotating force of the first and third gears 71 and 73, that is transmitted through the idle gears 82 and 84. The second gear 72 runs idle by the displacement of the piston rods 12 and 22, rotating in an arrow direction as shown in FIG. 9.

As described above, the rotating direction of the middle gear 83 does not change.

While the invention has been described in connection with what is presently considered to be most practical and preferred embodiments, it is to be understood that the invention is not limited to the disclosed embodiments, but on the contrary, it is intended to cover various modifications and equivalent arrangements included within the spirit and scope of the appended claims.

What is claimed is:

1. An engine with a rack gear-type piston rod, comprising:

first and second cylinders disposed oppositely to each other along a common axis, the cylinders respectively having first and second pistons that move back and forth along the common axis;

a piston rod, for connecting the first piston to the second piston, that is provided with upper and lower gear teeth formed on its opposing faces enabling back and forth motion that responds to the back and forth motion of the pistons;

a first gear train including a pair of gears meshing with the upper and lower gear teeth, respectively, the pair of gears rotating in an opposite direction to each other in response to the back and forth motion of the piston rod;

first and second one way clutches respectively mounted on each sides of the upper and lower gears;

first and second middle gears respectively connected with the first and second one way clutches through first and second shafts, respectively; and an output gear disposed between and engaged with the first and second middle gears, the output gear being connected to an output shaft.

2. The engine according to claim 1 further comprising a second gear train aligned with the first gear train.

3. The engine according to claim 1, wherein the piston rod has a rectangular section.

4. An engine with a rack gear-type piston rod, comprising:

first and second cylinders disposed oppositely to each other along a first common axis, the cylinders respectively having first and second pistons that move back and forth along the first common axis;

third and fourth cylinders disposed opposite to each other along a second common axis, the third and fourth cylinders respectively having third and fourth pistons that move back and forth along the second common axis;

a first piston rod, for connecting the first piston to the second piston, that is provided with upper and lower gear teeth formed on its opposing faces for enabling back and forth motion that responds to the back and forth motion of the first and second pistons;

a second piston rod, for connecting the third piston to the fourth piston, that is provided with upper and lower gear teeth formed on its opposing faces enabling back and forth motion that responds to the back and forth motion of the third and fourth pistons with a phase difference of 180 degrees;

a first gear train including at least three gears engaging the upper and lower portions of the first and second piston rods;

the three gears rotating in opposite directions in response to the back and forth motion of the piston rods;

one way clutches mounted on one sides of the three gears, respectively;

a second gear train including at least three middle gears each connected respectively to one of the one way clutches through the respective middle shaft and idle gears engaged between the middle gears; and an output gear connected to one of the middle gears of the second gear train.

5. The engine according to claim 4, wherein the piston rod has a rectangular section.

* * * * *